US011484133B2

(12) United States Patent
Twohy

(10) Patent No.: US 11,484,133 B2
(45) Date of Patent: Nov. 1, 2022

(54) MERCHANDISER INCLUDING CONDUCTIVE COATING TO HEAT FRAME

(71) Applicant: Hussmann Corporation, Bridgeton, MO (US)

(72) Inventor: Raymond P. Twohy, Saint Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 83 days.

(21) Appl. No.: 16/956,106

(22) PCT Filed: Dec. 19, 2017

(86) PCT No.: PCT/US2017/067271
§ 371 (c)(1),
(2) Date: Jun. 19, 2020

(87) PCT Pub. No.: WO2019/125408
PCT Pub. Date: Jun. 27, 2019

(65) Prior Publication Data

US 2021/0100372 A1 Apr. 8, 2021

(51) Int. Cl.
*A47F 3/04* (2006.01)
*F25D 21/04* (2006.01)

(52) U.S. Cl.
CPC ..... *A47F 3/0434* (2013.01); *A47F 3/0456* (2013.01); *A47F 3/043* (2013.01); *F25B 2400/22* (2013.01); *F25D 21/04* (2013.01)

(58) Field of Classification Search
CPC ..... A47F 3/0434; A47F 3/043; A47F 3/0456; F25D 21/04; F25B 2400/22
See application file for complete search history.

(56) References Cited

U.S. PATENT DOCUMENTS

| | | | |
|---|---|---|---|
| 3,859,502 | A | 1/1975 | Heaney |
| 4,127,765 | A | 11/1978 | Heaney |
| 4,248,015 | A | 2/1981 | Stromquist et al. |
| 4,260,876 | A | 4/1981 | Hochheiser |
| 5,255,473 | A | 10/1993 | Kaspar et al. |
| 5,852,284 | A | 12/1998 | Teder et al. |
| 6,144,017 | A | 11/2000 | Millett et al. |
| 6,606,833 | B2 | 8/2003 | Richardson et al. |

(Continued)

FOREIGN PATENT DOCUMENTS

| | | |
|---|---|---|
| EP | 0059545 A1 | 9/1982 |
| EP | 0406200 B1 | 8/1994 |

(Continued)

OTHER PUBLICATIONS

Examination Report issued from the Australia Patent Office for related Application No. 201744366 dated Mar. 29, 2021 (8 Pages).

(Continued)

*Primary Examiner* — Joseph F Trpisovsky
(74) *Attorney, Agent, or Firm* — Michael Best & Friedrich LLP

(57) ABSTRACT

A refrigerated merchandiser includes a case defining a product display area. A frame is connected to the case. The frame has a frame member with an exterior surface facing an ambient environment. A coating is on the exterior surface of the frame member. The coating includes conductive particles.

17 Claims, 9 Drawing Sheets

(56) References Cited

U.S. PATENT DOCUMENTS

| | | | | |
|---|---|---|---|---|
| 7,421,847 | B2 | 9/2008 | Murray et al. | |
| 7,968,823 | B2 | 6/2011 | Gerhardinger | |
| 8,946,597 | B2 * | 2/2015 | Zagdoun | C03C 17/23 219/203 |
| 9,016,031 | B2 | 4/2015 | Chubb et al. | |
| 2004/0065651 | A1 * | 4/2004 | Voeltzel | H05B 3/86 219/203 |
| 2006/0026975 | A1 | 2/2006 | Bunch et al. | |
| 2009/0324811 | A1 * | 12/2009 | Jung | H05B 3/146 427/113 |
| 2014/0265756 | A1 | 9/2014 | Rasch et al. | |
| 2015/0285551 | A1 | 10/2015 | Aiken et al. | |
| 2015/0351161 | A1 * | 12/2015 | Kramer | B60J 1/18 219/203 |
| 2016/0045038 | A1 | 2/2016 | Chubb | |

FOREIGN PATENT DOCUMENTS

| | | | |
|---|---|---|---|
| GB | 2529753 | A | 3/2016 |
| WO | 2010118938 | A2 | 10/2010 |

OTHER PUBLICATIONS

International Search Report and Written Opinion for Application No. PCT/US2017/067271 dated Sep. 11, 2018 (15 pages).

* cited by examiner

MERCHANDISER INCLUDING CONDUCTIVE COATING TO HEAT FRAME

BACKGROUND

The present invention relates to refrigerated merchandisers, and more specifically to condensation control for refrigerated merchandiser frame elements.

Existing refrigerated merchandisers generally include a case defining a product display area that supports and/or displays products visible and accessible through an opening in the front of the case. Some refrigerated merchandisers include doors that enclose the product display area of the case. The doors typically include one or more glass panels that allow a consumer to view the products stored inside the case. The doors are supported by a frame that includes a header, a footer, and a pair of side rails. If the merchandiser includes more than one door, mullions can be positioned between the doors, extending from the header to the footer.

Often, condensed moisture accumulates on one or more surfaces of the merchandiser, including exterior surfaces of the door and frame. Existing merchandisers often include a frame heater that is a wire element positioned inside of the frame. Typically, merchandisers include a single, continuous heater that extends inside frame along the outer edges and the mullions so that heat is applied to the interior of frame. By leaving the wire heating element on for a period of time, heat is conducted through the frame from the interior to the exterior, eventually heating the exterior surface and removing or reducing condensation. Heating through the frame member to achieve condensation reduction requires high power and/or longer heating times.

SUMMARY

According to an exemplary embodiment, a refrigerated merchandiser includes a case defining and separating a product display area from an ambient environment. A frame is connected to the case. The frame has a frame member with an interior portion facing the product display area and an exterior portion facing the ambient environment. A coating is layered on the frame between the exterior portion of the frame member and the ambient environment. The coating includes conductive particles. A door is pivotally connected to the frame and encloses at least a portion of the product display area. The door includes a door frame and a panel coupled to the door frame.

According to another exemplary embodiment, a refrigerated merchandiser includes a case defining and separating a product display area from an ambient environment. A frame is connected to the case. The frame has a frame member with an interior portion facing the product display area and an exterior portion facing the ambient environment. A coating is layered on the frame between the exterior portion of the frame member and the ambient environment. The coating includes conductive particles. An electrical connector is in contact with the coating and configured to operatively connect to a power supply.

Another exemplary embodiment relates to a method of reducing condensation on a refrigerated merchandiser. A case is provided defining and separating a product display area from an ambient environment. A frame is connected to the case and has a frame member with an interior portion facing the product display area and an exterior portion facing the ambient environment. A coating that includes conductive particles is applied to at least a portion of the frame member between the exterior portion and the ambient environment. Power is provided to the coating to generate heat and reduce condensation.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

DETAILED DESCRIPTION

Figure 1:
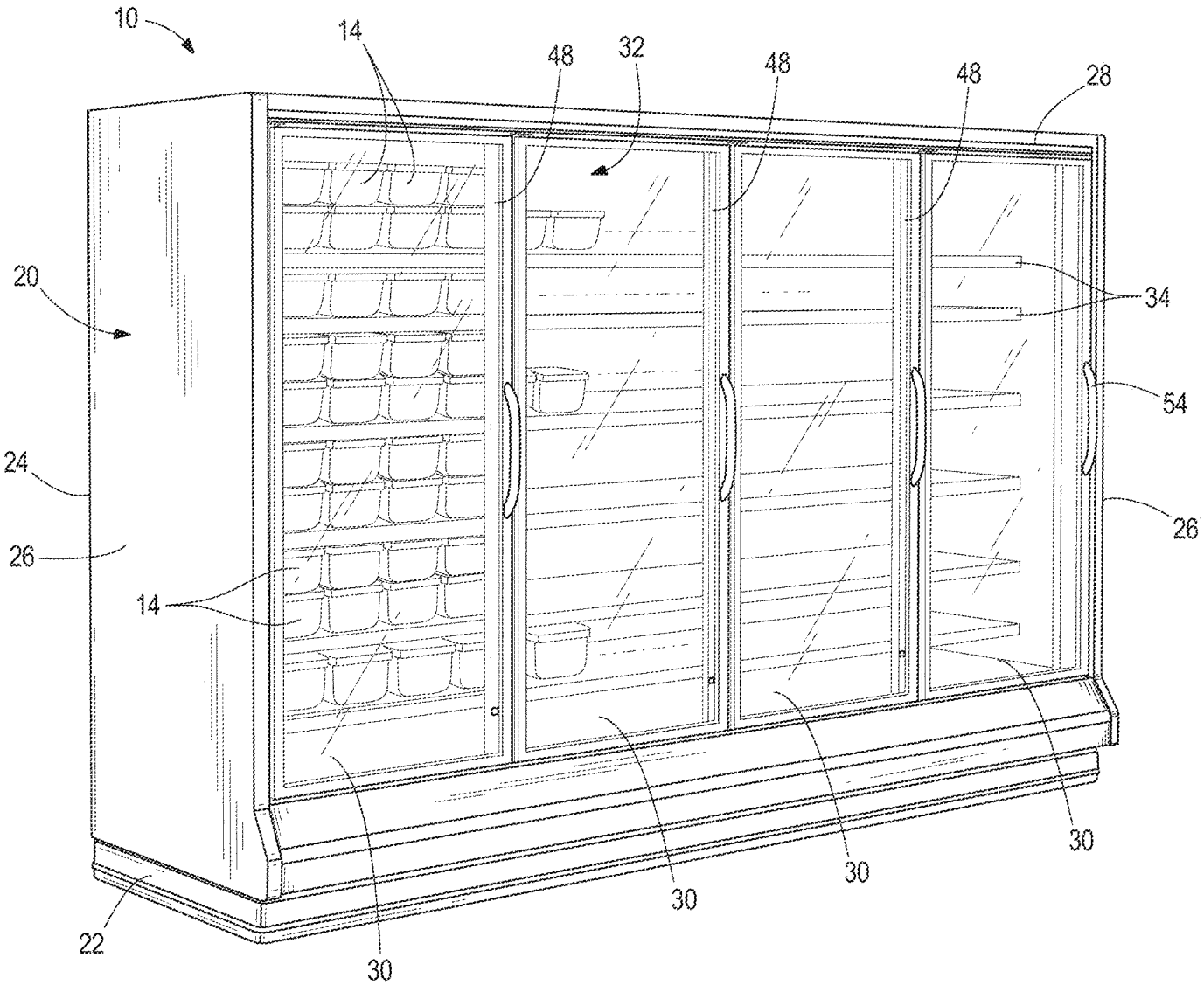
FIG. 1 is a front perspective view of a refrigerated merchandiser including a case and embodying the invention.

FIG. 1 illustrates an exemplary a refrigerated merchandiser 10 that may be located in a supermarket or a convenience store (not shown) for presenting fresh food, beverages, and other product 14 to consumers. As shown, the merchandiser 10 includes a case 20 that has a base 22, a rear wall 24, side walls 26, a canopy 28, and doors 30 that are coupled to the case 20. The area at least partially enclosed by the base 22, rear wall 24, side walls 26, and the canopy 28 defines a product display area 32 that supports the product 14 in the case 20. The product 14 is displayed on racks or shelves 34 extending forward from the rear wall 24, and is accessible by consumers through the doors 30 positioned adjacent the front of the case 20.

Figure 2:
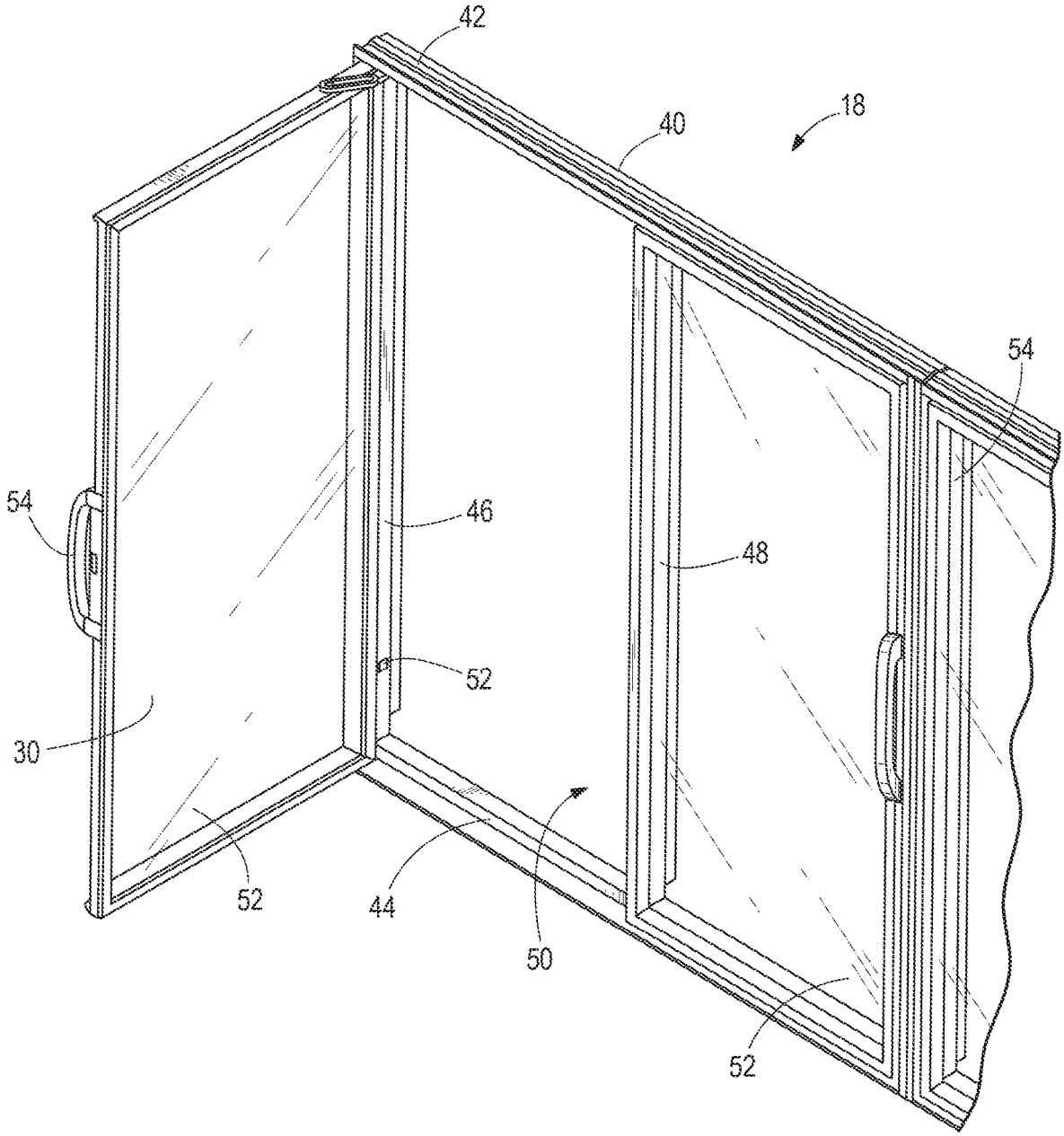
FIG. 2 is a perspective view of a portion of the merchandiser of claim 1 including a case frame and doors attached to the case frame.

With reference to FIG. 2, the case 20 includes a frame 40 that is located adjacent a front of the merchandiser 10 and that pivotally supports the doors 30. In an exemplary embodiment, the frame 40 has a series of frame members including a top frame member 42, a bottom frame member 44, a pair of end mullions 46 (only one shown), and one or more center mullions 48. The center mullions 48 define customer access openings 50 and support the doors 30 adjacent upper and lower extents of the mullions 48 so that the doors 30 can move to an open position to expose the openings 50. The openings 50 provide access to the product 14 stored in the product display area 32. The mullions 48 are structural members of the frame 40 spaced horizontally along the case 20. The frame members can be made by extruding metallic or non-metallic material (e.g., aluminum, plastic, carbon fiber, etc.), or by other manufacturing methods (e.g., molded, cast, etc.), and can have different sizes, shapes, and configurations. Each door 30 includes a panel 52 that has one or more glass panes so that product 14 can be viewed through the door 30 from outside the case 20. A handle 54 is coupled to each door 30 to facilitate opening and closing the door 30.

Figure 3:
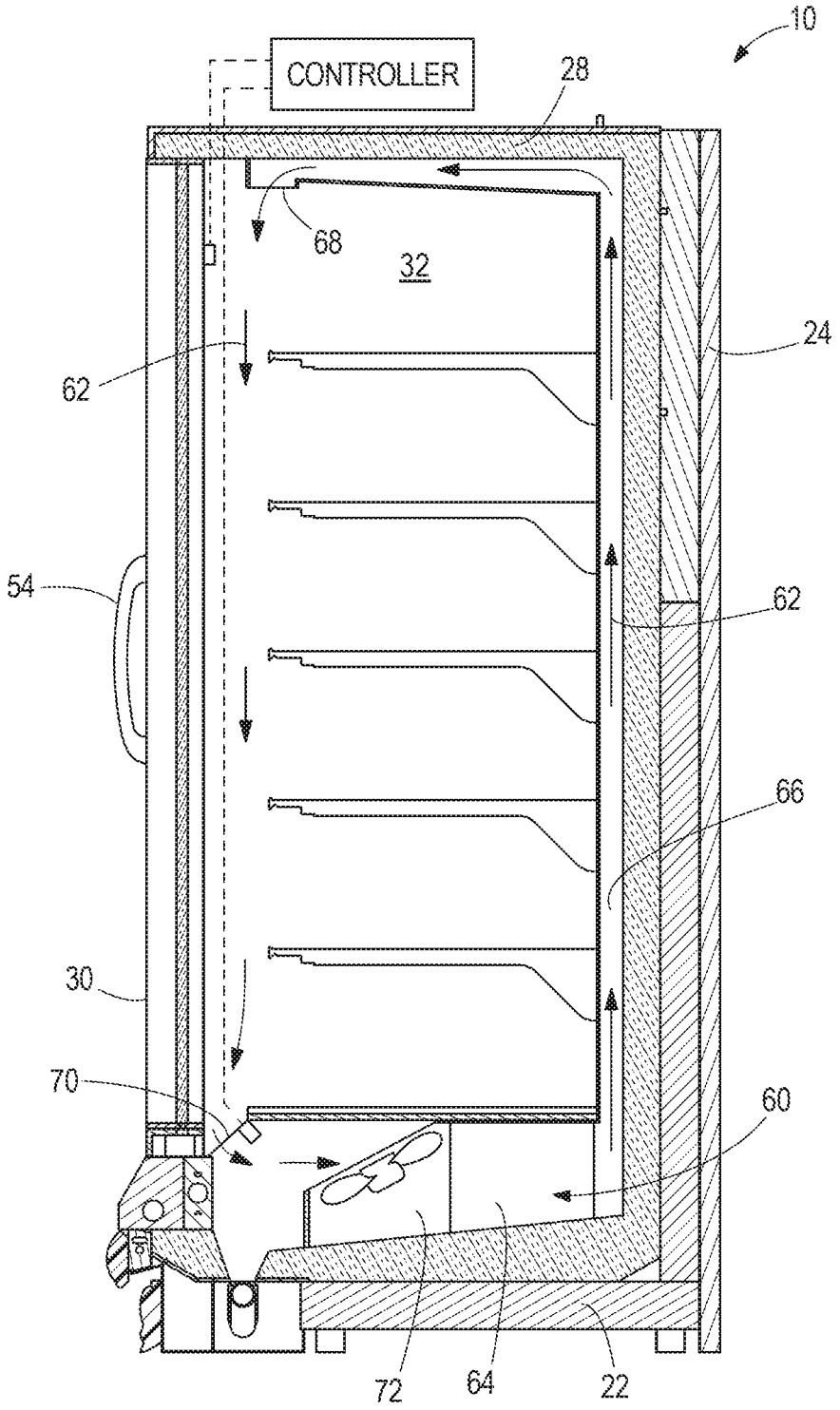
FIG. 3 is a schematic cross-section of the refrigerated merchandiser of FIG. 1.

Referring to FIG. 3, at least a portion of a refrigeration system 60 is in communication with case 20 to condition the product display area 32 via heat exchange relationship between a refrigerant flowing through the refrigeration system 60 and an airflow (denoted by arrows 62) that is directed toward the product display area 32. In some embodiments, the refrigeration system 60 includes an evaporator 64 that is coupled to the case 20 within an air passageway 66, a refrigerant driving device (e.g., a compressor or a pump—(not shown)), and a heat rejection heat exchanger (not shown). It will be appreciated that some components of the refrigeration system 60 (e.g., the driving device, the heat rejection heat exchanger such as a condenser or cooler, etc.) can be located remote from the merchandiser 10. Components and operation of the refrigeration system 60 are well known and will not be discussed in detail.

The airflow 62 is refrigerated or cooled by heat exchange with refrigerant in the evaporator 64. The refrigerated airflow 62 is directed into the product display area 32 through an air outlet 68 to condition the product display area 32 within a predetermined temperature range (e.g., 33-41 degrees Fahrenheit, approximately 32 degrees or below, etc.). Air is then is drawn into the air passageway 66 through an air inlet 70 via a fan 72 that is located upstream of the evaporator 64. Although the merchandiser 10 is illustrated and described with one passageway 66, it will be appreciated that the merchandiser can include two or more passageways. Furthermore, the illustrated merchandiser 10 is only exemplary and the merchandiser 10 may include other features.

Because the product display area 32 is maintained within a temperature range that is relatively cold when compared to the ambient environment surrounding the merchandiser, condensation can form on one or more surfaces of the frame 40, one or more surfaces of the glass panel 52, or both, when the temperature of the surface(s) falls below a threshold dew point temperature (i.e. based on the relative humidity of the ambient environment). Condensation is a result of a combination of surface temperature and moisture in the surrounding air. For example, condensation can form on one or more interior or exterior surfaces the frame 40 and/or the glass panel 52 after the door 30 has been opened due to exposure of the relatively cold interior case structure to warm ambient conditions. To remove condensation, the glass panel 52 can include a heated coating (not shown) affixed on a surface of one or more glass panes. The heated coating provides resistance heating via electrical power from a power source (not shown) to which the heated coating is connected. The heat provided by the heated coating quickly removes or "de-fogs" condensation formed when the door 30 is opened.

FIGS. 4-7 show one example of a portion of a bottom frame member 100 that includes a bottom rail 102 with an exterior portion 104 that faces the ambient environment and an interior portion 106 that faces the product display 14 area of a merchandiser 10. The exterior portion 104 of the bottom rail 102 includes a front edge 108 and a support surface 110 extending from the front edge 108. When connected to the merchandiser, the front edge 108 extends substantially perpendicular to the floor and along the width of the merchandiser, with the outer surface of the front edge facing the ambient environment.

A vertical wall 112 extends substantially perpendicular from the support surface 110. A lower wall 114 extends substantially perpendicular to the vertical wall 112. A connecting wall 115 extends between the lower wall 114 and an upper wall 116. The lower wall 114, connecting wall 115, and the upper wall 116 cooperate to partially define a gasket channel 118 that is configured to receive a door gasket (not shown). An outer cover 120 is connected to the exterior portion 104 of the bottom rail 102 and an inner cover 122 is connected to the interior portion 106 of the bottom rail 102.

Figure 4:
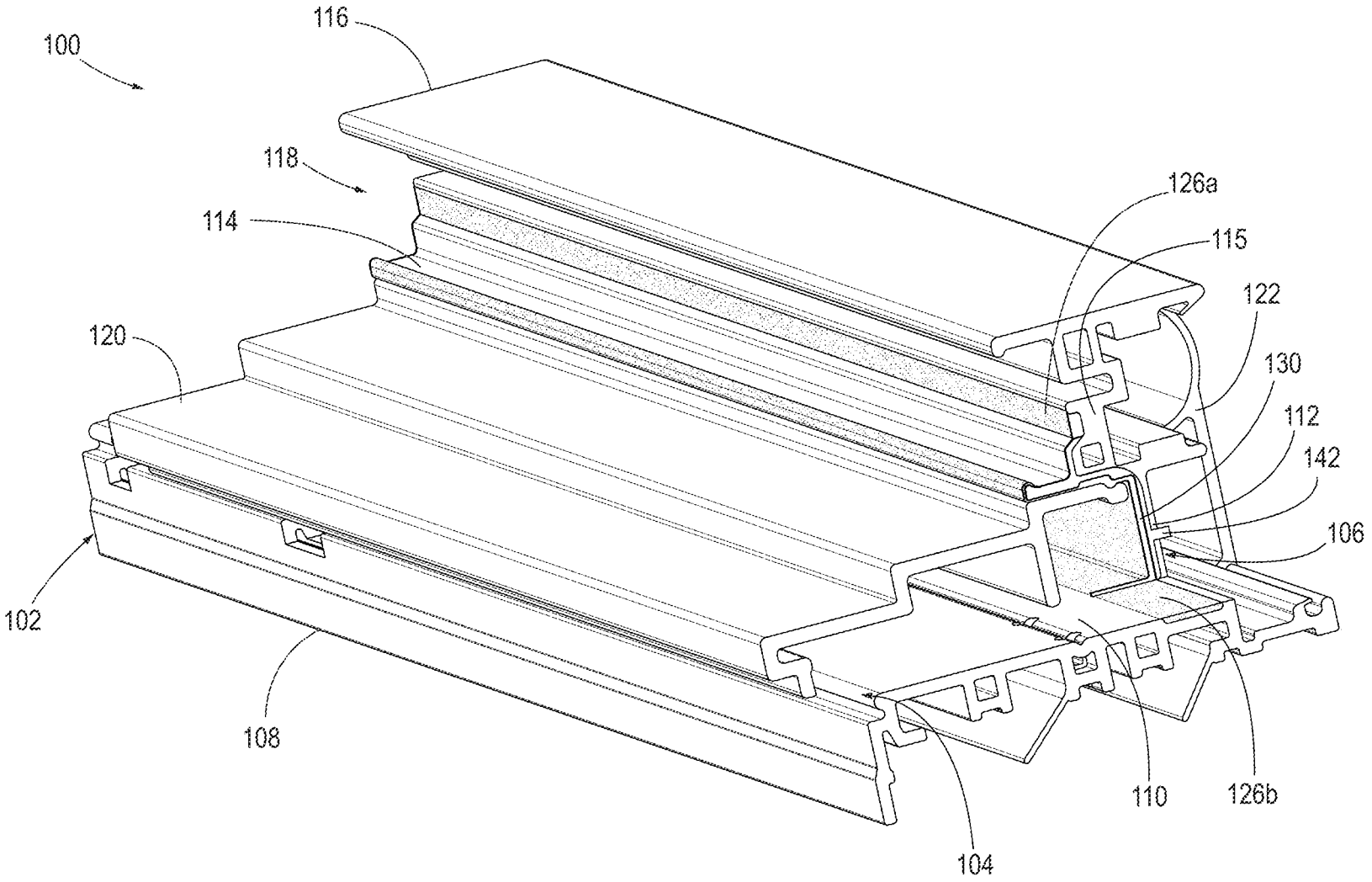
FIG. 4 is a perspective view of a bottom frame member of the case frame including a bottom rail member, an outer cover, an inner cover, and a conductive coating applied to portions of the bottom rail member.
Figure 5:
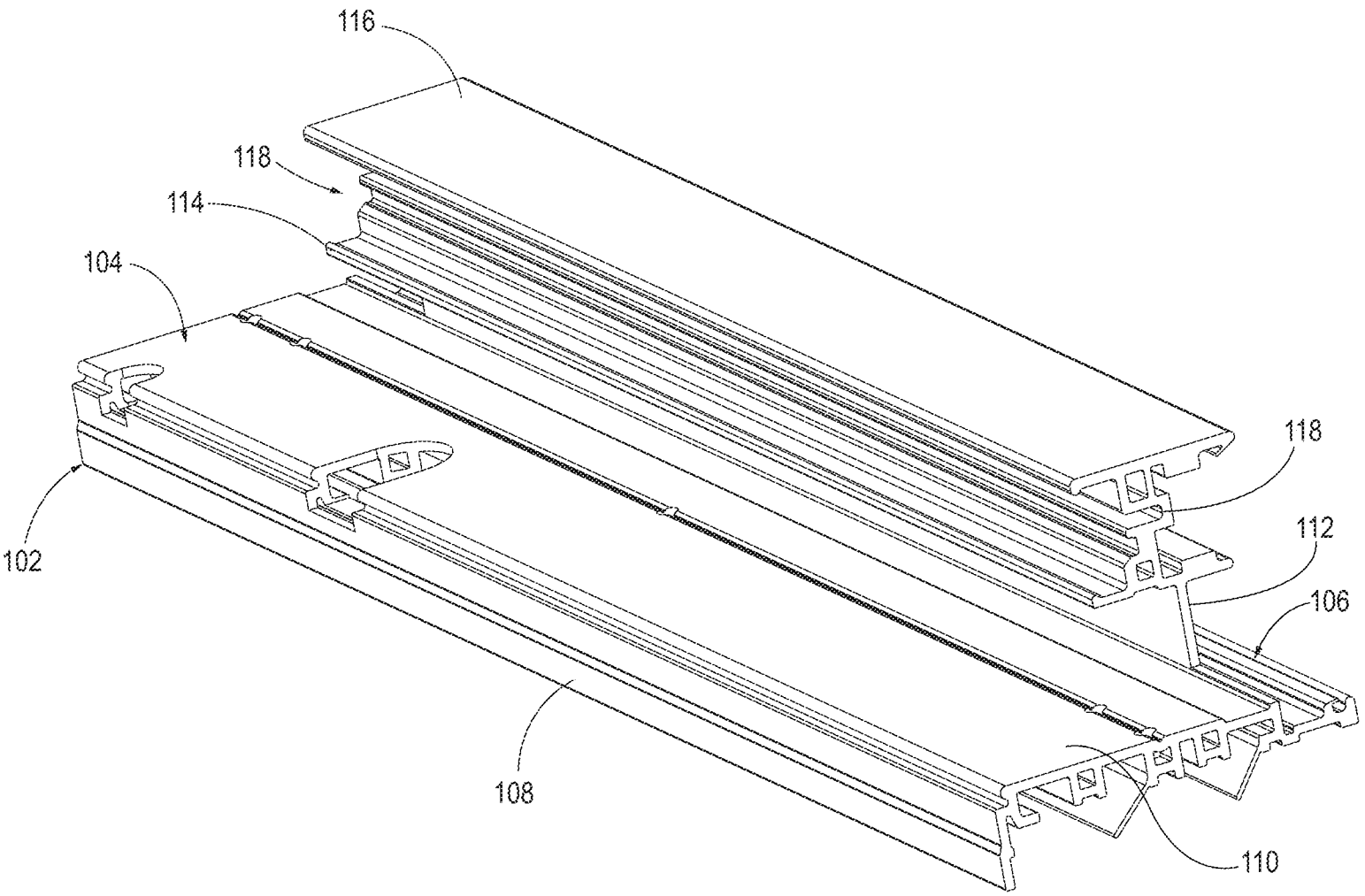
FIG. 5 is a perspective view of the bottom rail member of FIG. 4 without the conductive coatings.
Figure 6:
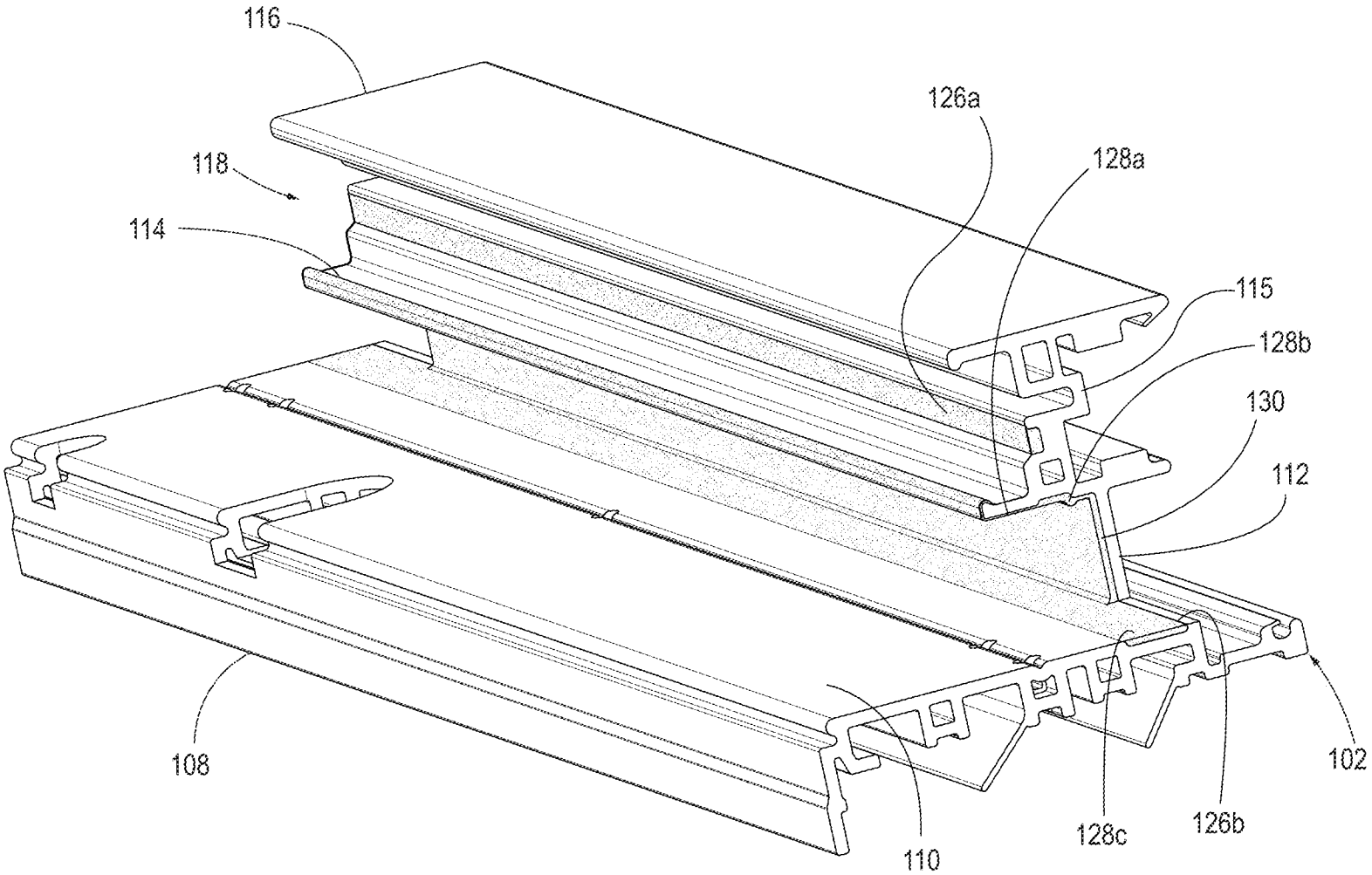
FIG. 6 is perspective view of the bottom rail member and conductive coating of FIG. 4.
Figure 7:
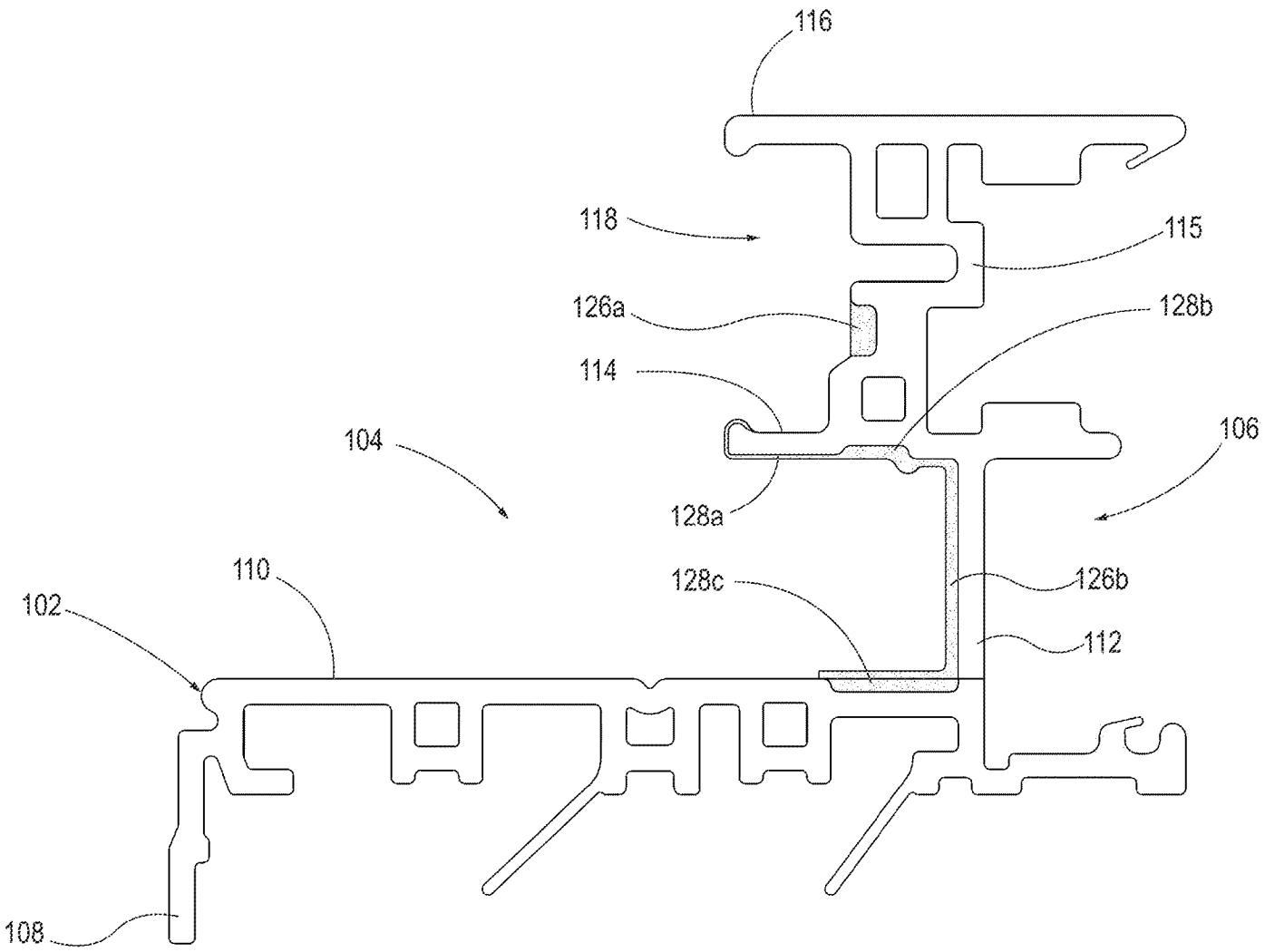
FIG. 7 is a side view of FIG. 6 illustrating the lower frame rail and the conductive coating.

With continued reference to FIGS. 4-7, the bottom frame member 100 includes conductive coating sections disposed on one or more surfaces of the exterior portion 104 of the bottom rail 102. FIGS. 4, 6, and 7 show a first conductive coating section **126*a* disposed on a portion of the connecting wall 115, and a second conductive coating section 126*b* that is continuous from an upper surface of the lower wall 114 to the support surface 110 such that the coating section 126*b* covers a portion of an upper surface of the lower wall 114, extends around a front edge of the lower wall 114, extends along a lower surface of the lower wall 114, extends along the vertical wall 112, and extends along at least a portion of the support surface 110**.

The first conductive coating section **126*a* has a substantially uniform thickness. The second conductive coating section 126*b* has a variable thickness from where the coating section starts on the upper surface of the lower wall 114 to where the second conductive coating section 126*b* terminates on the support surface 110. The second conductive coating section 126*b* includes a first portion 128*a* that has at a first thickness, a second portion 128*b* that has a second thickness greater than the first thickness, and a third portion 128*c* that has a third thickness greater than the first thickness. The thickness of the third portion 128*c* can also be greater than the thickness of the second portion 128*b*. Referring to FIGS. 5 and 7, the second portion 128*b* and the third portion 128*c* of the second conductive coating section 126*b* are applied in channels formed in the bottom rail 102. Each of the conductive coating sections 126*a*, 126*b*** can include any number of portions with varying thickness.

The conductive coating is defined by a medium containing one or more conductive particles. The medium can be a bonding agent, for example an acrylic paint and the conductive particles are carbon particles. The carbon particles can be at least 40% by weight of the coating, or for example in the range of 40-60% by weight of the conductive coating. In some embodiments, the coating is opaque or semi-opaque. When electricity is supplied to the conductive coating, heat is generated through electrical resistance. The heat generated by the conductive coating is used to warm the exterior portion 104 of the bottom rail 102, helping to prevent condensation formation on the frame. The thickness of the conductive coating can correlate to the amount of generated heat, with thicker portions generating more heat than thinner portions. For example, the thicker second portion **128*b* of the second conductive coating section 126*b* will generate more heat than the first portion 128*a***. The thickness of the conductive coating can be controlled by forming grooves in the surface having different depths, and applying the conductive coating so it has an outer surface substantially continuous with the surrounding outer surfaces.

Figure 8:
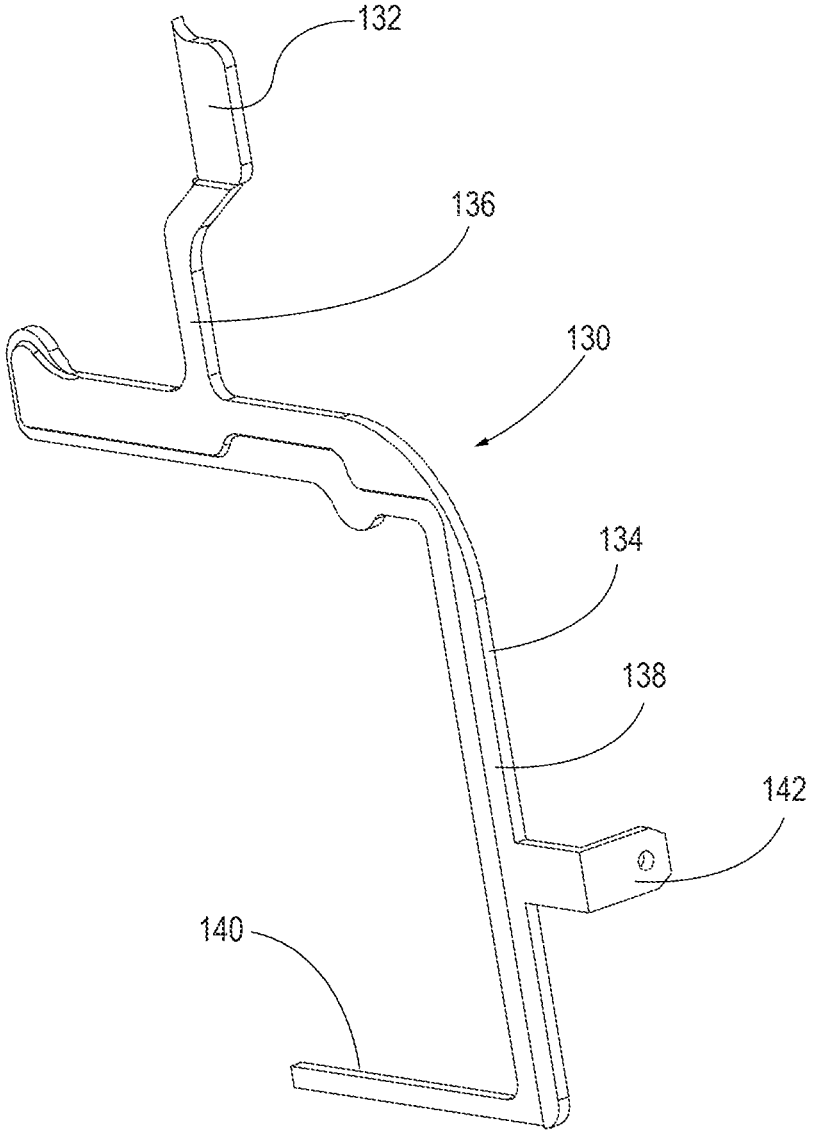
FIG. 8 is a perspective view of the electrical connector of FIG. 4.
Figure 9:
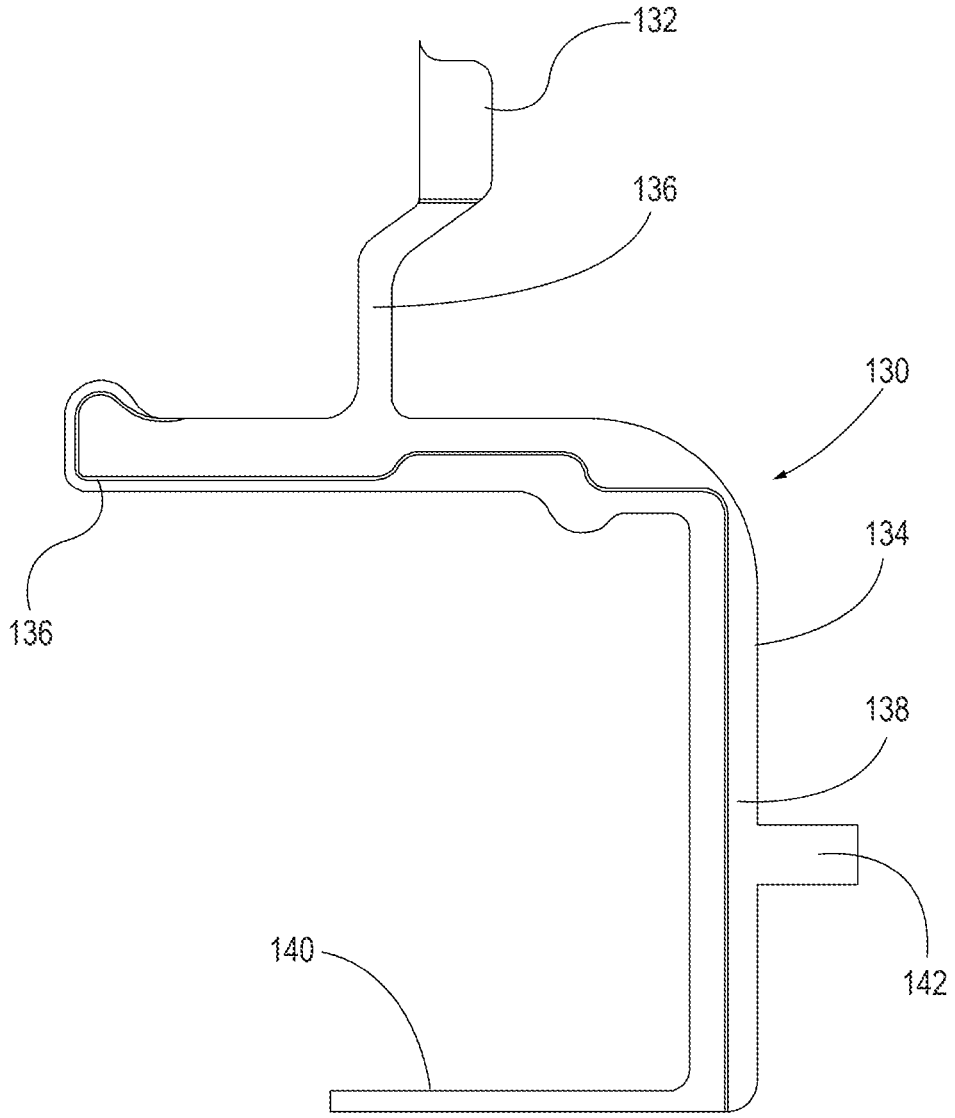
FIG. 9 is a side view of the electrical connector of FIG. 8.

FIGS. 4, 8, and 9 show an exemplary embodiment of an electrical connector 130 used to apply electricity to the conductive coating. The connector 130 includes a thin strip of conductive material, for example a flexible metal or foil, which is attached to the edge of the bottom rail 102. The connector 130 is formed to have a configuration that allows it to engage at least a portion of both the first and second conductive coating sections 126*a*, 126*b*, although more than one connector 130 may also be used. As shown in FIGS. 8 and 9, the connector 130 includes an upper portion 132 configured to engage the first conductive coating section 126*a*, a lower portion 134 configured to engage the second conductive coating section 126*b*, and an intermediate portion 136 bridging the upper portion 132 and the lower portion 134. Referring to FIG. 4, the upper portion 132 of the connector 130 has substantially the same size and shape as the first conductive coating section 126*a* and the lower portion 134 of the connector 130 has a first portion 136 extending along the lower wall 114, a second portion 138 extending along the vertical wall 112, and a third portion 140 extending along the top of the conductive coating applied on the support surface 110. Although a single connector 130 is shown, another connector can be positioned on the opposite edge of the bottom rail 102.

The connector 130 is configured to be electrically connected to a power supply (not shown) and is capable of supplying current to the first and second conductive coatings 124, 126. The connector 130 includes a tab 142 extending from the second portion 138. An electrical contact (not shown) is connected to the tab 142 to provide power to the connector 130. The tab 142 can be bent (e.g., see FIG. 8) and has an opening that can be used to secure the contact, for example with a fastener. Because the conductive coatings 124, 126 are applied to the exterior portion 104 of the bottom rail 102, less heat is needed to reduce or eliminate condensation than for an interior heater element that would need to heat through the thickness of the bottom rail 102. Low voltage can therefore be applied to the conductive coating, which will also eliminate any risk of shock or harm to a user. For example, 30 volts or less can be supplied to the conductive coatings 124, 126.

Although the conductive coating is shown applied in specific locations, the location and amount of conductive coating can be varied. For example, a conductive coating may be applied to any other portion of the exterior portion 104 or to the entire exterior portion 104. The conductive coating can also be applied to other exterior surfaces of the merchandiser or other areas that will help prevent condensation formation. This can include other portions of the frame such as the top frame member, end mullions, and center mullions.

The invention claimed is:

1. A refrigerated merchandiser comprising:

a case defining a product display area and including a frame;

a coating disposed on the frame and in communication with an ambient environment, wherein the coating includes conductive particles, and wherein the coating has a first coating section with a first thickness on the frame and a second coating section with a second thickness on the frame that is different from the first thickness, and wherein one or both of the first coating section and the second coating section are disposed in one or more channels of the frame having a depth corresponding to the thickness of the coating section that is disposed in the one or more channels, wherein the first thickness correlates to a first amount of heat configured to be generated by the first coating section and the second thickness correlates to a second amount of heat configured to be generated by the second section.

2. The refrigerated merchandiser of claim 1, wherein the conductive particles include carbon particles.

3. The refrigerated merchandiser of claim 2, wherein the coating includes at least 40% by weight of carbon particles.

4. The refrigerated merchandiser of claim 1, wherein the second coating section is spaced from the first coating section.

5. The refrigerated merchandiser of claim 1, wherein the frame has an exterior surface facing an ambient environment, and wherein at least a portion of the coating on the exterior surface is directly exposed to the ambient environment.

6. The refrigerated merchandiser of claim 1, wherein the coating is at least semi-opaque.

7. The refrigerated merchandiser of claim 1, further comprising an electrical connector in contact with the coating and configured to operatively connect to a power supply and provide power to the coating.

8. The refrigerated merchandiser of claim 1, wherein the coating includes a bonding agent.

9. A refrigerated merchandiser comprising:

a case defining a product display area;

a frame connected to the case and having a frame member;

a coating on the frame member and disposed in one or more channels of the frame member, the one or more channels having a depth corresponding to a thickness of the coating, and the coating including conductive particles; and an electrical connector in contact with the coating and configured to operatively connect to a power supply.

10. The refrigerated merchandiser of claim 9, wherein the coating includes at least 40% by weight of carbon particles.

11. The refrigerated merchandiser of claim 9, wherein the frame member includes a bottom rail member of the case.

12. The refrigerated merchandiser of claim 9, wherein the electrical connector includes a tab configured to receive an electrical contact.

13. The refrigerated merchandiser of claim 9, wherein the coating includes a first coating section having a first thickness and a second coating section having a second thickness greater than the first thickness, and wherein the first thickness and the second thickness correlate to an amount of heat configured to be generated by the coating.

14. The refrigerated merchandiser of claim 9, wherein the coating includes a first coating section and a second coating section spaced from the first section.

15. The refrigerated merchandiser of claim 14, wherein the electrical connector includes an upper portion engaging the first coating section, a lower portion engaging the second coating section, and an intermediary portion connecting the upper portion and the lower portion.

16. A method of reducing condensation on a refrigerated merchandiser comprising:

providing a case defining a product display area, wherein a frame is connected to the case and has a frame member in communication with an ambient environment;

applying a coating to the frame member, the coating including conductive particles and in communication with an ambient environment, the coating having a first coating section with a first thickness on the frame member and a second coating section with a second thickness on the frame member that is different from the first thickness, wherein one or both of the first coating section and the second coating section are disposed in one or more channels of the frame member having a depth corresponding to the thickness of the coating section that is disposed in the one or more channels, and wherein the first thickness correlates to a first amount of heat configured to be generated by the first coating section and the second thickness correlates to a second amount of heat configured to be generated by the second section; and providing power to the coating to generate heat and reduce condensation.

17. The method of claim 16, wherein applying the coating includes adjusting the thickness of the coating to adjust the amount of heat generated in a portion of the coating.

* * * * *